United States Patent [19]

Kornblit

[11] 4,380,760

[45] Apr. 19, 1983

[54] SMOKE DETECTOR WITH DELAYED ALARM AFTER CHANGE TO STAND-BY POWER

[75] Inventor: Morris J. Kornblit, Pittsburgh, Pa.

[73] Assignee: General Electric Company, New York, N.Y.

[21] Appl. No.: 247,878

[22] Filed: Mar. 26, 1981

Related U.S. Application Data

[63] Continuation-in-part of Ser. No. 123,274, Feb. 21, 1980, abandoned.

[51] Int. Cl.[3] ..... G08B 17/10; G08B 1/08

[52] U.S. Cl. ..... 340/628; 340/529; 340/333; 340/663

[58] Field of Search ..... 340/628, 629, 630, 333, 340/529, 663

[56] References Cited

U.S. PATENT DOCUMENTS

| | | | |
|---|---|---|---|
| 2,736,012 | 2/1956 | Bland et al. | 340/333 X |
| 3,060,416 | 10/1962 | Brown | 340/333 X |
| 3,569,964 | 3/1971 | Mande | 340/333 X |
| 3,634,846 | 4/1969 | Fogiel | 340/629 X |
| 3,979,739 | 9/1976 | Birchall | 340/529 |
| 3,979,740 | 9/1976 | Forbat et al. | 340/529 X |
| 4,088,986 | 5/1978 | Boucher | 340/333 X |
| 4,138,670 | 2/1979 | Schneider et al. | 340/629 X |
| 4,155,081 | 5/1979 | Haglund | 340/629 |

FOREIGN PATENT DOCUMENTS

| | | | |
|---|---|---|---|
| 417030 | 9/1934 | United Kingdom | 340/333 |

*Primary Examiner*—John W. Caldwell, Sr.
*Assistant Examiner*—Daniel Myer
*Attorney, Agent, or Firm*—George R. Powers; Leonard J. Platt; John F. Cullen

[57] ABSTRACT

The smoke detector is powered by standard AC current and a stand-by power source consisting of rechargeable batteries. A detector is provided for detecting the loss or failure of AC power, and the shift to the stand-by power source. The power loss detector initiates a time delay after which the smoke detector signal alarm is energized to alert the user about the loss of AC power. If AC power is restored before the time delay interval, the signal is not energized since the user need not be alerted. If the alarm is energized to alert the user of a loss of AC power, a manual reset switch may be used to terminate the alarm. If the manual reset switch is not used, the alarm is terminated automatically upon the restoration of AC power.

11 Claims, 6 Drawing Figures

SMOKE DETECTOR WITH DELAYED ALARM AFTER CHANGE TO STAND-BY POWER

BACKGROUND OF THE INVENTION

This application is a continuation-in-part of copending application Ser. No. 123,274, abandoned, for "Smoke Detector With Delayed Alarm After Change to Stand-By Power", filed on Feb. 21, 1980, by the same inventor and assigned to the same assignee, said copending earlier application being incorporated herein by reference.

1. Field of the Invention

The invention generally relates to smoke detectors, and particularly to photoelectric or ionization smoke detectors commonly used as inexpensive smoke alarms in private residences. The invention is particularly useful in smoke detectors which have several power sources, and particularly for smoke detectors which are designed to be energized by household alternating current, with stand-by battery power.

2. Description of the Prior Art

In electronic smoke detectors, it is extremely important to have a reliable power source in order to be sure that the smoke detector is operative whenever it is needed to detect the existence of a fire. If household alternating current is used as the power source, then the power source may fail at exactly the time when it is needed because the same event which causes the start of the fire, such as a lightning strike, may also cause the household power to fail. On the other hand, if battery power is employed, the battery will eventually fail through aging and discharge. For the above reasons, a number of proposals have been made previously for providing stand-by sources of power for smoke detectors, as described, for instance, in the following U.S. patents: No. 4,081,684 - Wieder, No. 4,065,759 - Handing, and No. 3,594,751 - Ogden. While the power source is not the main subject of the Wider patent, in the introduction of that patent it is stated that the device may be powered with AC current with a stand-by battery and with automatic switching to the stand-by battery in the event of AC power failure. It is also stated that upon AC current failure, an alarm device may be actuated. The Handing patent appears to call for essentially the same combination. The Ogden patent provides two DC power sources.

In each of these prior systems, there is an important problem and disadvantage in that, no matter how brief the primary power source failure may be, the power failure alarm necessarily is sounded, giving rise to an alarm signal which may be essentially meaningless. It is extremely important that any alarm signal from a smoke detector should be taken very seriously. Accordingly, it is a great disadvantage to have an alarm signal which occurs in response to a routine and brief power interruption.

SUMMARY OF THE INVENTION

It is an important object of the present invention to provide an improved smoke detector apparatus having a main power source and a stand-by power source and an alarm to indicate the loss of the main power source which avoids the major disadvantage of a needless alarm when the interruption of the main power source is brief.

Another object of the invention is to provide a delayed alarm indicating the loss of the main power source and to provide means for removing the alarm either upon restoration of the main power source or upon acknowledgment of the alarm by a user.

Yet another object is to provide the foregoing objects in a system which automatically resets itself upon the restoration of the main power source such that it will indicate the occurrence of a subsequent loss of the main power source.

Briefly stated, in carrying out the invention in one form, there is provided a smoke detector apparatus including means for receiving energizing power from a first power source, a stand-by power source automatically operable to supply power to said apparatus upon failure of said first power source, a first switching means connected to said means for receiving energizing power and operable upon failure of the first power source, a time delay means connected to be triggered on by said first switching means upon failure of said first power source, a second switching means connected to be triggered on by said time delay means at the end of the time delay period, a signal means connected for energization by said second switching means at the end of the time delay period, and reset means connected to said means for receiving energizing power and operable upon reestablishment of power from the first power source prior to the timing out of said time delay means to reset said time delay means to prevent the energization of said signal means.

In accordance with further aspects of the invention, the reset means is also responsive to a restoration of power from the first power source after the time delay means has timed out to reset the time delay means and turn off the signal means. Manually resettable means are also provided for permitting the signal means to be turned off by a user prior to the restoration of power from the first power source.

BRIEF DESCRIPTION OF THE DRAWINGS

While the novel features of the invention are set forth with particularity in the appended claims, the invention, both as to organization and content, will be better understood and appreciated, along with other objects and features thereof, from the following description taken in connection with the drawings, in which:

DESCRIPTION OF THE PREFERRED EMBODIMENT

Figure 1:
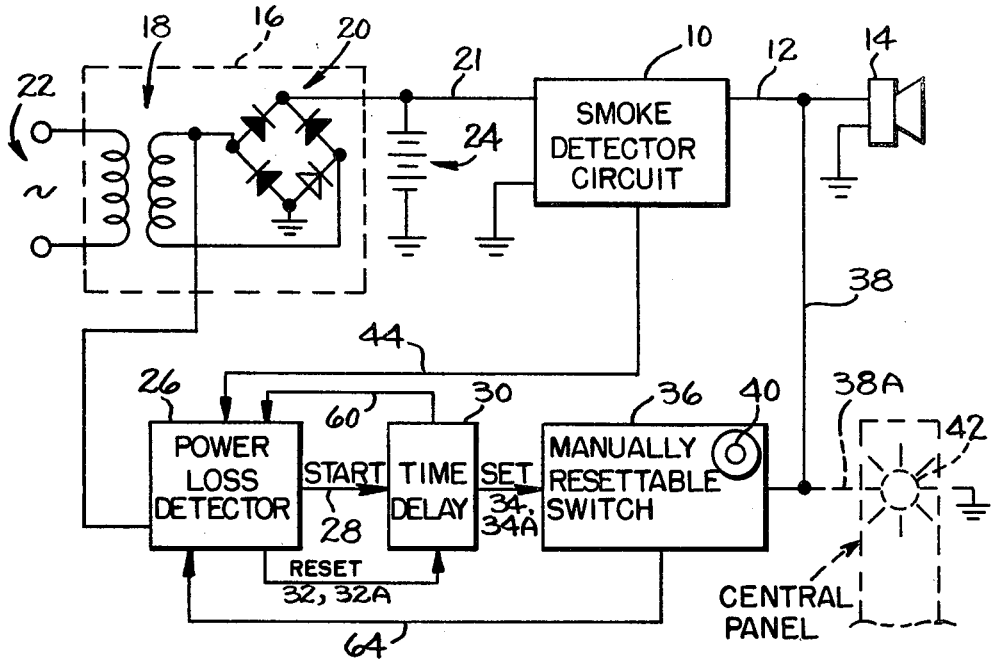
FIG. 1 is a schematic circuit diagram of a smoke detector incorporating the present invention.

Referring particularly to FIG. 1, a conventional smoke detector circuit is indicated schematically at 10, which is connected at 12 to an audible alarm signal device 14 to signal the user that smoke has been detected, and that a fire is probably present. The smoke detector circuit 10 may preferably be either of the photoelectric type, or of the ionization type. The smoke detector circuit 10 is powered normally through a circuit 16 consisting of a voltage stepdown transformer 18 and a full wave rectifier 20 and connection 21. The circuit 16 is arranged to receive conventional alternating current power at terminals 22 connected to the primary winding of transformer 18. A stand-by DC power source is also provided for the smoke detector circuit 10 in the form of a rechargeable battery 24 upon which the charge is maintained by the circuit 16. If the AC power fails, the diodes of the full wave rectifier 20 electrically isolate the battery 24 from the circuit 16, and battery 24 then provides standby power to the smoke detector circuit 10. The capacity of battery 24 may be selected to maintain power to smoke detector 10 for a desired period such as from several hours to several days or more.

Connected to the circuit 16, across the low voltage secondary of the transformer 18 are the inputs to a first switching device 26 which operates as an alternating current power loss detector. The switching device 26 operates in response to the presence of alternating current electric power by periodically generating "start" or "count" signals on connection 28 and subsequently generating "stop" or "reset" signals on connections 32, 32A in a manner hereinafter described in detail. These signals are supplied to the appropriate inputs of a time delay circuit 30, which starts counting down in response to start or count signals on connection 28, but resets to its zero condition upon the subsequent delivery of a stop signal on connections 32, 32A. Thus, as long as the alternating current power is available and the power loss detector circuit 26 is continually generating sequential signals on connections 28 and 32, 32A, the time delay circuit 30 cannot "time out" since it is being continually started and reset. Upon loss of power, however, the switching device 26 generates start or count signals on connection 28 on a continuing basis without generating subsequent stop or reset signals on connections 32, 32A. As a result, the time delay circuit 30 will time out unless a reset signal is supplied over one or both of connections 32, 32A prior to the end of the timing interval.

When the time delay circuit 30 times out, the resulting outputs on connections 34, 34A serve as a "set" input to a manually resettable switch 36, causing that switch 36 to provide power through a connection 38, and connection 12, to the signal device 14. This alerts the user to the fact that the alternating current power source has failed, and that the smoke detector is now powered only by the limited life stand-by power source 24. When the user hears the alarm and investigates, he can turn off the alarm signal 14 by pushing a button switch indicated schematically at 40, which is part of the manually resettable switch 36, to reset that switch to the off position.

Whether or not the button 40 has been pushed to reset the resettable switch 36 to the off position, the time delay circuit 30 will be reset from the connections 32, 32A whenever alternating current electric power is restored, and the switch 36 will be ready to be set again in response to an output signal from the time delay 30 on connection 34 due to any new AC power failure.

If desired, another signal device 42 may be connected at 38A to provide a visual indication of the alarm condition at the smoke detector, or at a central panel in the building, along with other signal indicators for other smoke detectors. The signal 42 may also be employed as an alternative to the connection 38 to the signal alarm 14. When the visual signal 42 is employed as an alternative to the audible signal alarm 14 to indicate AC power failure, the connection 38 is simply eliminated.

Figure 2:
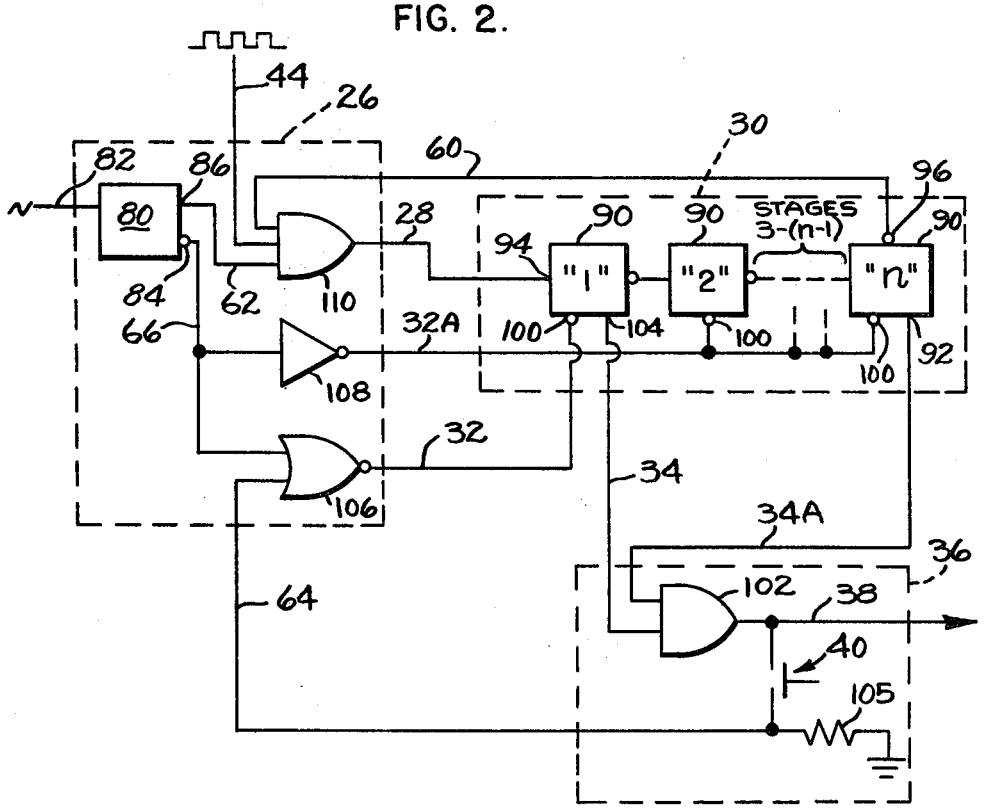
FIG. 2 is a detailed schematic diagram of the functional blocks 26, 30 and 36 of FIG. 1.
Figure 3:
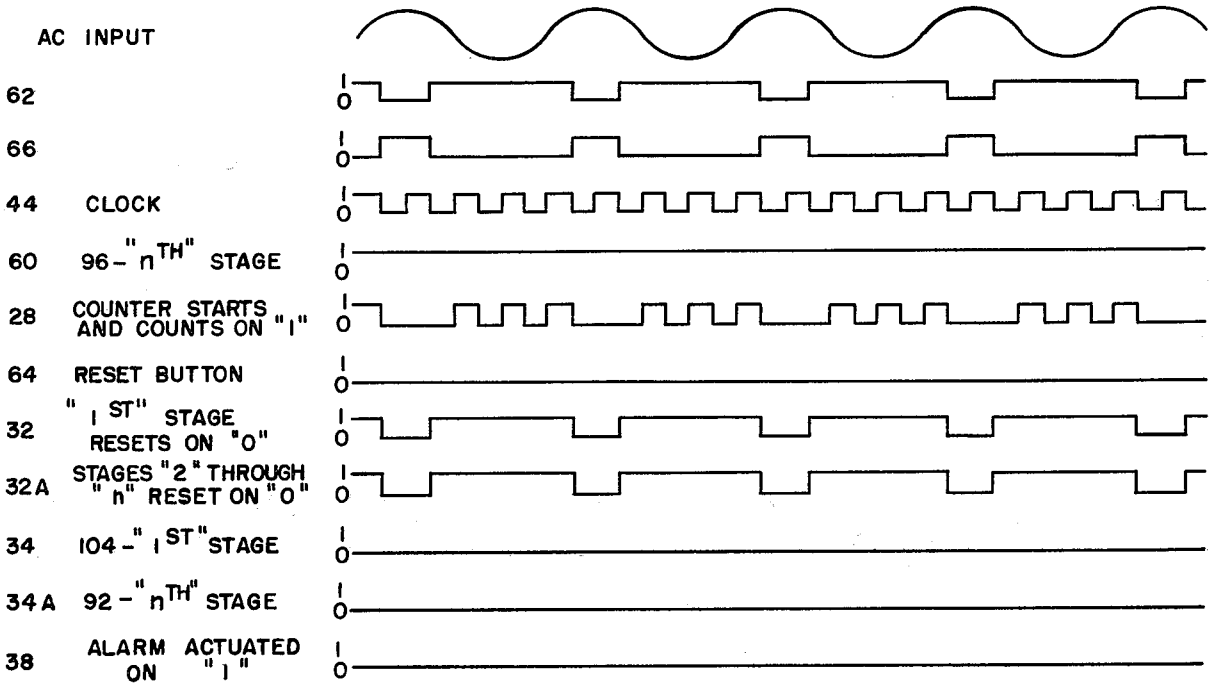
FIG. 3 is a timing diagram illustrating normal operation with alternating current electric power being continuously supplied.

With reference now to FIGS. 1 and 2, the power loss detector 26, the time delay circuit 30, and the manually resettable switch 36 will be described in more detail. The power loss detector 26 includes a Schmitt trigger 80 of the 9601 type as described on page 13–14 of the August 1973 edition of *The TTL Applications Handbook*, published by Fairchild Semiconductor. The Schmitt trigger 80 includes an input 82 coupled to the transformer 18 and a pair of outputs 84 and 86. When a signal having a positive magnitude exceeding a predetermined level is supplied to input 82, a positive output pulse (logic level "1") is produced at output 84 for a predetermined duration and "0" at all other times. The output 86 is supplied at all times with the complement of the output signal at 84 as also shown by FIG. 3 with respect to connection 62. The connections 62 and 66 are connected to logic gates in a manner which will be described below.

Still referring to FIGS. 1 and 2, the time delay circuit 30 may conveniently be comprised of a number of discrete counters coupled together to form a multistage counter. More particularly, each stage 90 can conveniently comprise a variable modulo 9305 counter of the type described on pages 9-6, 8 and 10 of the *National Semiconductor TTL Data Book*, 1976 edition. Each of the "n" stages of counters may be arranged in a modulo 16 mode such that the subsequent stage may receive an input count on the sixteenth count of the immediately proceeding stage in a manner well known in the art. In this manner, the output at terminal 92 of the "nth" stage changes from a low logic level, "0", to a "1" upon delivery of the $16^n$ signal "1" to the input 94 of the first stage. Simultaneously, the output at 96 changes from "1" to "0". If at any time the signals supplied to the reset inputs 100 of the counters change from "1" to "0", the corresponding stages will be reset to their zero counts.

The manually resettable switch 36 may conveniently comprise an AND gate 102 having a pair of inputs coupled to the output 104 of the first stage counter 90 through connection 34 and to the output 92 of the "nth" stage counter 90 through connection 34A. The output of the AND gate 102 is connected through line 38 to the alarm 14 as described above and to the normally open switch 40. The other side of the normally open switch 40 is connected to ground through a resistor 105 and to one of a pair of inputs to a NOR gate 106 through a connection 64, the NOR gate 106 forming part of the power loss detector 26.

The second input of the NOR gate 106 is connected by line 66 to the output 84 of the Schmitt trigger 80 and the output of the NOR gate 106 is connected by line 32 to the reset input 100 of the first stage counter 90. The connection 66 from the Schmitt trigger 80 is also coupled through a NOT gate 108 and line 32A to the reset terminals 100 of all of the remaining stages of counters 90. The power loss detector 26 also includes an AND gate 110 having three inputs connected, respectively, over line 62 to the output 86 of the Schmitt trigger 80, line 60 to the output 96 of the "nth" stage counter 90, and line 44 to a source of continuous clock pulses. If the smoke detector circuit 10 includes a source of clock pulses, the line 44 may be connected to the smoke detector circuit as illustrated by FIG. 1 for receiving clock pulses directly therefrom. Otherwise, any appropriate source of clock pulses may be utilized, such as an MC 1555 or MC 1455 timer as described on page 8-302 of Vol. 6 of *Linear Intergrated Circuits, Series A,* of the Semiconductor Data Library of Motorola Semiconductor Products, Inc., 1975.

The operation of the system during normal availability of alternating current electric power will now be described with reference to FIGS. 1 through 3. When the signal at output 84 of the Schmitt trigger goes to the "1" level, "0" signals are transmitting over lines 32 and 32A to the reset terminals 100 of all counter stages 90 to reset the counter 30 to zero. Simultaneously, the signal at output 86 is "0" to assure that the output of the AND gate on line 28 is also "0". The input to the AND gate 110 from output 96 of the "nth" stage 90 is held at the "1" level since this signal goes to "0" only upon the $16^n$ count registered by the counter 30. The signals on line 44 continuously alternate between "0" and "1" at the count rate. As soon as the output from 84 goes to the "0" level, the output from 86 goes to the "1" level, and the AND gate 110 thereafter passes the "1" pulses over line 28 to the output 94 of the first stage 90 until the outputs at 84 and 86 again switch to the "1" and "0" levels, respectively to reset all counter stages. This occurs long before $16^n$ pulses pass through the AND gate 110; consequently, the signals from outputs 92 and 104 of the "nth" stage and the first stage counters, respectively, are never simultaneously "1" during the delivery of alternating current power. As a result, the output on line 38 to the alarm 14 remains at the "0" level, and the alarm does not sound.

Figure 4:
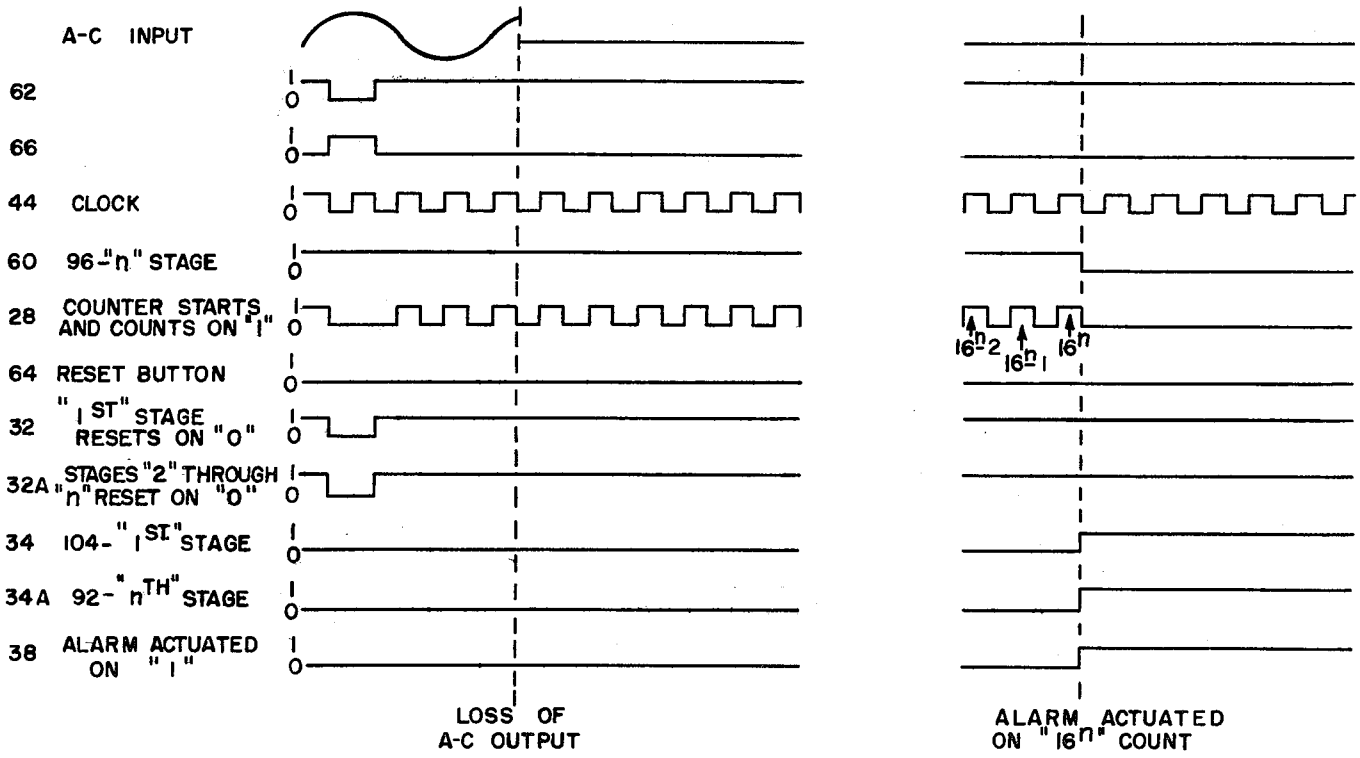
FIG. 4 is a timing diagram illustrating the delayed generation of an alarm upon the loss of alternating current electric power.

Operation when alternating current power is lost will now be described with reference to FIGS. 1, 2 and 4. When alternating current power is lost, the output 84 (connection 66) of the Schmitt trigger 80 goes to "0" for the duration of the power loss, and the output 86 (connection 62) goes to "1" for the duration of the power loss. As a result, AND gate 110 continuously passes the "1" count pulses to the input 94 of the first stage 90 over line 28, and no "0" reset signals are delivered to the reset terminals 100 since line 66 is at the "0" level and line 64 is connected to ground ("0") through the resistor 104. The counter 30 counts until the $16^n$ pulse is registered, at which time the signals at outputs 92 (line 34A) and 104 (line 34) of the counter stages simultaneously go to the "1" level for the first time. As a result, the AND gate 102 passes a "1" signal to the alarm 14 over connection 38 to turn on the alarm 14. Simultaneously, the signal at output 96 (connection 60) of the "nth" stage 90 goes to "0" for the first time, the "0" output signal being supplied over line 60 to the AND gate 110 to prevent the transmission of additional counts to the counter 30. As a result, the state of the counter 30 is frozen with logic levels "1" being present on lines 34 and 34A and logic level "0" being present on line 60. The alarm 14 will continue to sound so long as the logic level "1" remains on the line 38 to the alarm.

It will be seen that the actuation of the alarm 14 is delayed for the period that is required for the counter to register $16^n$ clock pulses. The delay may range over a broad spectrum depending upon the requirements of the designer. For example, it may be desirable for the delay to be for only a second or so in order to merely avoid the generation of an alarm upon the occurrence of a momentary loss of power. Alternatively, many counting stages may be used to assure that an alarm will be sounded only as a result of power losses of long duration.

Figure 5:
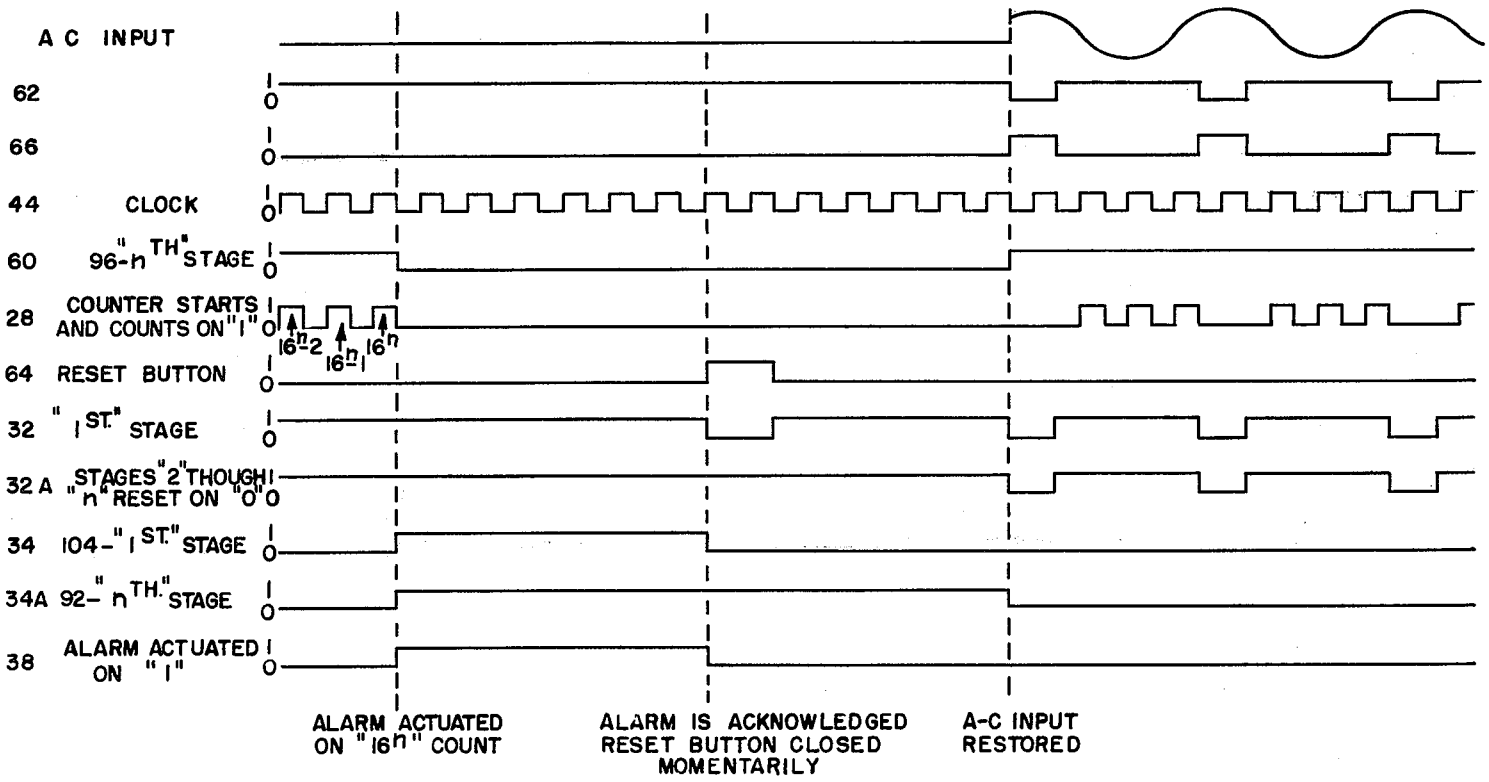
FIG. 5 is a timing diagram illustrating operation upon acknowledgement of loss of alternating current power through operation of the reset switch and upon subsequent restoration of the alternating current power.

On some occasions, such as the middle of the night in a private residence, the user may wish to turn off the power loss alarm without disabling the smoke detector 10 by removing the battery 24. The manner in which this can be accomplished will now be described with reference to FIGS. 1, 2 and 5. After the alarm 14 has been sounded in the manner described above, the manual button 40 may be depressed briefly to transmit over line 64 the signal "1" (existing on line 38) to the NOR gate 106. When this occurs, a "0" signal is supplied over line 32 to the reset terminal 100 of the first stage only of the counter 30. As a result, the output at terminal 104 of the first stage 90 changes from the "1" level to the "0" level, and the output on line 38 to the alarm 14 from the AND gate 102 also changes from the "1" level to the "0" level to turn off the alarm. Since only the first stage of the counter is reset, the outputs of the "nth" stage do not change; the "0" on line 60 is unchanged and thus continues to prevent the transmission of counting pulses over line 28 to the counter 30.

Upon the restoration of alternating current power, the first "1" signal generated at output 84 of the Schmitt trigger 80 is transmitted over lines 32 and 32A to reset all stages 90 of the counter 30. When this occurs, the output signal from terminal 96 of the "nth" stage returns to the "1" level, and the system thereafter operates in the manner described above with respect to FIG. 3. In particular, in the event of a future loss of power, the alarm 14 will again be sounded after the appropriate delay period. This is an extremely important feature since it is often desirable to shut off the alarm for the duration of a particular power outage, but it is not desirable to permanently disable the alarm capability.

Figure 6:
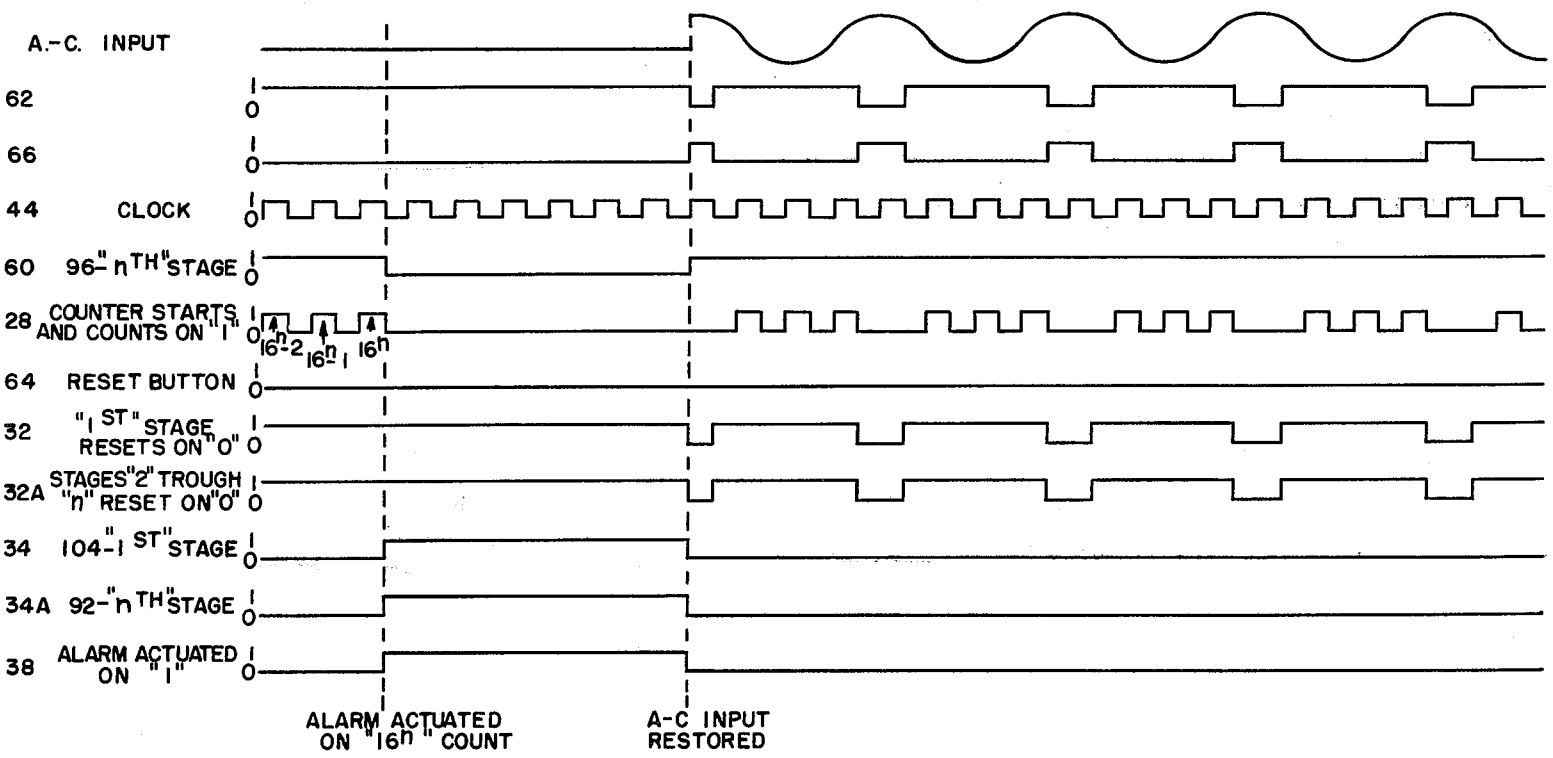
FIG. 6 is a timing diagram illustrating the generation of an alarm upon loss of alternating current electric power and the subsequent automatic removal of the alarm upon the restoration of alternating current electric power.

On other occasions, the resettable button 40 may not be actuated. In such cases, the power failure alarm will sound until the alternating current power is restored. The manner by which this occurs is illustrated by FIGS. 1, 2 and 6. When power is restored, all stages 90 of the counter are reset upon the first "1" signal supplied over line 66 to the NOR gate 106 and the NOT gate 108. As a result, the signals on lines 34 and 34A to the AND gate switch to "0", and the signal on line 38 switches to "0" to turn off the alarm. At the same time, the signal over line 60 to the AND gate 110 switches from "0" to "1". Thereafter, operation is identical to that described above with respect to FIG. 3.

It will be understood that the schematic circuits, as shown, are somewhat simplified. Thus, for instance, if an alternating signal current is required to energize the horn 14, the AC horn energizing converter is housed within the horn itself, as illustrated. Furthermore, the sound emitted for AC power failure should be different from the sound emitted for the detection of smoke, and different from any sound emitted upon battery failure, so that the user will be able to distinguish between one problem and another. Accordingly, an intermittent signal switching device may be included at the output of the manually resettable switch 36 to provide an intermittent signal at a distinctive interruption frequency or in a distinctive pulse sequence to provide a distinctive signal for AC power failure.

As illustrated in the circuit diagram, if the signal light 42 is included in the circuit, and if the interconnection 38 is retained, the light 42 will be energized for the detection of smoke, as well as for an AC power failure. Accordingly, if it is desired to avoid having the signal light 42 energized upon the detection of smoke, a suitable relay or other similar switching device may be interposed in the connection 38 to provide for the transmission of the AC power failure signal to the horn 14, but to prevent the transmission of a smoke detection signal from circuit 10 to the signal light 42. It is also evident that separate visual signals, such as lights, could be provided to signal the loss of AC power and the detection of smoke, respectively, or the visual signal could be steady for one condition and flashing for another condition.

It will be understood that the power loss detector 26, the time delay 30, and the manually resettable switch 36 will require power inputs (not shown) from the power input line 21.

In the preferred embodiment of the invention, the emergency or stand-by power source 24 is preferably a rechargeable storage battery. However, if desired, a non-rechargeable dry cell battery may be employed for this purpose. In such an arrangement, the power loss detector switch 26 may include means for switching the power connection 21 to the smoke detector circuit 10 from the main AC power source to the stand-by power source 24 so that the stand-by power source need not be continuously connected in the circuit.

It will be understood that other routine modifications of the invention may be made without departing from the spirit of the invention. For instance, with some storage batteries, it may be desirable to avoid continuous connection to a charging circuit. Accordingly, means may be provided for intermittently connecting and disconnecting the full wave rectifier 20 and the storage battery 24, permitting the storage battery 24 to provide power to the smoke detector circuit 10 exclusively when the rectifier circuit 20 is disconnected from the battery 24. It will be understood that, in such a modification, the alternating current power still remains the primary power source, and the power loss detector 26 and the associated circuitry will still operate, with an appropriate delay, to sound the alarm if the primary power is lost to the circuit.

While this invention has been shown and described in connection with a particular preferred embodiment, it is apparent that various changes and modifications, in addition to those mentioned above, may be made by those who are skilled in the art without departing from the basic features of the invention. Accordingly, it is the intention of the Applicant to protect all variations and modifications within the true spirit and valid scope of this invention.

What is claimed as new and is desired to secure by Letters Patent of the United States is:

1. A smoke detector apparatus including:

means for receiving energizing power from a first power source, a stand-by power source automatically operable to supply power to said apparatus upon failure of said first power source, a first switching means connected to said means for receiving energizing power and operable upon failure of the first power source, a time delay means connected to be triggered on by said first switching means upon failure of said first power source, a second switching means connected to be triggered on by said time delay means at the end of the time delay period, a signal means connected for energization by said second switching means at the end of the time delay period, and reset means connected to said means for receiving energizing power and operable upon reestablishment of power from the first power source prior to the timing out of said time delay means to reset said time delay means to prevent the energization of said signal means.

2. Apparatus as claimed in claim 1 wherein said reset means comprises a part of said first switching means.

3. Apparatus as claimed in claim 1 wherein there is provided a manual means associated with said second switching means for resetting said time delay means to terminate the energization of said signal means by said second switching means.

4. Apparatus as claimed in claim 1 wherein said signal means is connected with said smoke detector apparatus to alternatively provide a signal in response to the detection of smoke.

5. Apparatus as claimed in claim 1 wherein said means for receiving energizing power from a first power source is adapted to receive power from an alternating current power source.

6. Apparatus as claimed in claim 5 wherein said stand-by power source is comprised of at least one electric storage battery.

7. Apparatus as claimed in claim 6 wherein said means for receiving energizing power from a first power source includes means for maintaining an electrical charge on said electrical storage battery.

8. Apparatus as claimed in claim 7 wherein said means for receiving energizing power from a first power source includes a transformer and a full-wave rectifier.

9. Apparatus as claimed in claim 1 wherein said first switching means is operable upon the reestablishment of power from the first power source to reset said time delay means to thereby place the apparatus in condition to again detect the failure of the first power source.

10. Apparatus as claimed in claim 1 wherein said first switching means comprises a circuit which is operable to continually change state and which is connected to alternately start and reset said time delay means as it changes state during the continuation of power and which is operable to switch to a first state to start said time delay without subsequent reset in the absence of power from the first power source.

11. Apparatus as claimed in claim 1 wherein said signal means comprises an electric lamp for providing a visual signal, and wherein said smoke detector apparatus includes a separate audible signal means to provide an audible signal in response to the detection of smoke.

* * * * *